US009589498B2

(12) United States Patent
Lee

(10) Patent No.: US 9,589,498 B2
(45) Date of Patent: Mar. 7, 2017

(54) DISPLAY DRIVER AND DISPLAY DEVICE

(71) Applicant: EverDisplay Optronics (Shanghai) Limited, Shanghai (CN)

(72) Inventor: Ching-Hung Lee, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 58 days.

(21) Appl. No.: 14/697,313

(22) Filed: Apr. 27, 2015

(65) Prior Publication Data

US 2015/0325199 A1 Nov. 12, 2015

(30) Foreign Application Priority Data

May 8, 2014 (CN) ..... 2014 1 0193160

(51) Int. Cl.
*G09G 5/00* (2006.01)
*G09G 3/32* (2016.01)

(52) U.S. Cl.
CPC ..... *G09G 3/3208* (2013.01); *G09G 3/3266* (2013.01); *G09G 5/00* (2013.01); *G09G 2300/0861* (2013.01); *G09G 2310/08* (2013.01); *G09G 2330/00* (2013.01)

(58) Field of Classification Search
None
See application file for complete search history.

(56) References Cited

U.S. PATENT DOCUMENTS

2006/0290390 A1* 12/2006 Jang ..... G11C 19/28 327/112
2014/0111092 A1* 4/2014 Kim ..... H05B 37/02 315/127

* cited by examiner

*Primary Examiner* — Jennifer Mehmood
*Assistant Examiner* — Stephen T Reed
(74) *Attorney, Agent, or Firm* — Yunling Ren

(57) ABSTRACT

A display driver comprises a plurality of driver stages. For each stage, a source node of a first transistor is coupled to a first power supply, a gate node is coupled to a first node, and a drain node is coupled to a first output end. A source node of a second transistor is coupled to the first output end and a gate node of is coupled to a second controller and a drain node is electrically coupled to a first input end. The first controller is coupled to a second input end and a third input end to provide sampled signals to the first node and a second output end. The second controller is coupled to the first controller and a second power supply. The first output end of each driver stage is coupled to the third input end of the next driver stage.

13 Claims, 3 Drawing Sheets

DISPLAY DRIVER AND DISPLAY DEVICE

CROSS-REFERENCE TO RELATED APPLICATIONS

This application claims the benefits of Chinese Patent Application No. 201410193160.2, filed on May 8, 2014 in the Patent Office of China, the disclosure of which is incorporated herein by reference in its entirety.

TECHNICAL FIELD

The present disclosure relates in general to control circuits for displays and, in particular, to a display driver and a display device having the same.

BACKGROUND

Recently, various flat panel displays with less weight and smaller size compared with cathode-ray tube (CRT) display have been developed, e.g. a liquid crystal display (LCD), a field emission display (FED), a plasma display panel and an organic light-emitting display.

Among flat panel displays, organic light-emitting displays display images by using organic light-emitting diodes (OLED) which give out light by recombination of electron and hole. Organic light-emitting displays have faster respond speed and smaller driving power. A typical organic light-emitting display provides currents to OLED according to data signals through transistors formed in pixels, and thereby, OLEDs give out light.

A typical organic light-emitting display includes a data driver providing data signals to data lines, a scan driver providing scan signals to scan lines, an emission control line driver providing emission control signals to emission control lines, and a display unit including a plurality of pixels electrically coupled to the data lines, the scan lines and the emission control lines.

When the scan signals are provided to the scan lines, the pixels included in the display unit are selected to receive the data signals from the data lines. The pixels receiving the data signals generate light with the luminance according to the data signals, and display an image. Here, the emission time of pixels are determined by the emission control signals provided from the emission control lines. Typically, the emission control signals are provided to overlap with the scan signal(s) provided to one or two scan line(s).

Therefore, the emission control line driver includes stages electrically coupled to the emission control lines. These stages receive at least four clock signals and output high level voltage or low level voltage to output lines.

The stages included in a typical emission control line driver are driven by at least four clock signals, and a lot of transistors are needed.

The above information disclosed in this Background section is only for enhancement of understanding of the background of the disclosure and therefore it may contain information that does not form the prior art that is already known in this country to a person of ordinary skill in the art.

SUMMARY OF THE INVENTION

Focusing on the problems in the prior art, the present disclosure provides a display driver and a display device thereof, which solve the existing problems, and turn traditional four clock signals into three signals to drive. So that it can achieve same functions by using less control signal, which can save the area of circuit diagram, reduce the area of integrated circuit and the number of bonding zones, improve the reliability, and increase the operating space for component operations.

Additional aspects and advantages will be set forth in part in the description which follows and, in part, will be apparent from the description, or may be learned by practice of the disclosure.

In one aspect, the present disclosure provides a display driver comprising a plurality of driver stages, each of which comprising a first input end, a second input end, a third input end, a first output end, a second output end, a first transistor, a second transistor, a first controller and a second controller. A source node of the first transistor is electrically coupled to a first power supply, a gate node of the first transistor is electrically coupled to a first node, and a drain node of the first transistor is electrically coupled to a first output end. A source node of the second transistor is electrically coupled to the first output end and a gate node of the second transistor is electrically coupled to the second controller, and a drain node of the second transistor is electrically coupled to a first input end. The first controller is electrically coupled to a second input end and a third input end to provide sampled signals to the first node and a second output end. The second controller is electrically coupled to the first controller and a second power supply. The first output end of each driver stage is electrically coupled to the third input end of the next driver stage.

According to some embodiments, the first input end is configured to receive a first clock signal, the second input end is configured to receive a second clock signal, and the first clock signal and the second clock signal do not overlap each other.

According to some embodiments, the third input end of a first driver stage is configured to receive a single pulse signal.

According to some embodiments, the first controller comprises a third transistor, having a source node electrically coupled to the first power supply, a gate node electrically coupled to the second input end and a drain node electrically coupled to a second node; a fourth transistor, having a source node electrically coupled to the second node, a gate node electrically coupled to the third input end and a drain node electrically coupled to the third input end; a fifth transistor, having a source node electrically coupled to the first power supply, a gate node electrically coupled to the second node and a drain node electrically coupled to a third node; a sixth transistor, having a source node electrically coupled to the third node, a gate node electrically coupled to the second input end and a drain node electrically coupled to the second input end; a seventh transistor, having a source node electrically coupled to the second node, a gate node electrically coupled to the third node and a drain node electrically coupled to the first power supply; an eighth transistor, having a source node electrically coupled to the first power supply, a gate node electrically coupled to the second node and a drain node electrically coupled to the first node; and a first capacitor electrically coupled between the second node and the first power supply.

According to some embodiments, the second controller comprises a ninth transistor, having a source node electrically coupled to the second power supply, a gate node electrically coupled to a fourth node and a drain node electrically coupled to the third node; a tenth transistor, having a source node electrically coupled to the third node, a gate node electrically coupled to second power supply and a drain node; an eleventh transistor, having a source node electrically coupled to the drain node of the tenth transistor, a gate node electrically coupled to the second power supply and a drain node electrically coupled to the fourth node; a twelfth transistor, having a source node electrically coupled to the first node, a gate node electrically coupled to the fourth node and a drain node electrically coupled to the second power supply; a thirteenth transistor, having a source node electrically coupled to the second node, a gate node electrically coupled to the second power supply and a drain node; a fourteenth transistor, having a source node electrically coupled to the drain node of the thirteenth transistor, a gate node electrically coupled to the second power supply and a drain node electrically coupled to the gate node of the second transistor; and a second capacitor electrically coupled between the first node and the fourth node.

According to some embodiments, an output voltage of the second power supply is lower than that of the first power supply.

In another aspect, the present disclosure provides a display device, comprising a plurality of driver stages, a single pulse signal line and three clock signal lines, each of the plurality of driver stages comprising a first transistor, a second transistor, a first controller and a second controller. A source node of the first transistor is electrically coupled to a first power supply, a gate node of the first transistor is electrically coupled to a first node, and its drain node electrically coupled to a first output end. A source node of the second transistor is electrically coupled to the first output end and a gate node of the second transistor is electrically coupled to a second controller and a drain node of the second transistor is electrically coupled to a first input end. The first controller is electrically coupled to a second input end and a third input end to provide sampled signals to the first node and a second output end. The second controller is electrically coupled to the first controller and a second power supply. The first output end of each driver stage is electrically coupled to the third input end of the next driver stage. The second output end of each driver stage output a light emitting control signal for the display device. The third input end of a first driver stage is electrically coupled to the single pulse signal line. Three successive driver stages are configured as a drive circuit group, in which the first input end and the second input end of each driver stage are respectively electrically coupled to two clock signal lines of the three ones.

According to some embodiments, the three driver stages receive different clock signals from one another.

According to some embodiments, three clock signals respectively on the three clock signal lines do not overlap with one another.

According to some embodiments, the first controller comprises a third transistor, having a source node electrically coupled to the first power supply, a gate node electrically coupled to the second input end and a drain node electrically coupled to a second node; a fourth transistor, having a source node electrically coupled to the second node, a gate node electrically coupled to the third input end and a drain node electrically coupled to the third input end; a fifth transistor, having a source node electrically coupled to the first power supply, a gate node electrically coupled to the second node and a drain node electrically coupled to a third node; a sixth transistor, having a source node electrically coupled to the third node, a gate node electrically coupled to the second input end and a drain node electrically coupled to the second input end; a seventh transistor, having a source node electrically coupled to the second node, a gate node electrically coupled to the third node and a drain node electrically coupled to the first power supply; an eighth transistor, having a source node electrically coupled to the first power supply, a gate node electrically coupled to the second node and a drain node electrically coupled to the first node; and a first capacitor electrically coupled between the second node and the first power supply.

According to some embodiments, the second controller comprises a ninth transistor, having a source node electrically coupled to the second power supply, a gate node electrically coupled to a fourth node and a drain node electrically coupled to the third node; a tenth transistor, having a source node electrically coupled to the third node, a gate node electrically coupled to second power supply and a drain node; an eleventh transistor, having a source node electrically coupled to the drain node of the tenth transistor, a gate node electrically coupled to the second power supply and a drain node electrically coupled to the fourth node; a twelfth transistor, having a source node electrically coupled to the first node, a gate node electrically coupled to the fourth node and a drain node electrically coupled to the second power supply; a thirteenth transistor, having a source node electrically coupled to the second node, a gate node electrically coupled to the second power supply and a drain node; a fourteenth transistor, having a source node electrically coupled to the drain node of the thirteenth transistor, a gate node electrically coupled to the second power supply and a drain node electrically coupled to the gate node of the second transistor; and a second capacitor electrically coupled between the first node and the fourth node.

According to some embodiments, an output voltage of the second power supply is lower than that of the first power supply.

According to some embodiments, the display device is one selected from a group consisting of an organic light-emitting display, a liquid crystal display, a field emission display and a plasma display panel.

Compared with the prior art, the present disclosure may have one or more of the following technical effects. The display driver and the display device thereof of the disclosure turn traditional four clock signals into three signals to drive, so that it can achieve same functions by using less control signal, which can save the area of circuit diagram, reduce the area of integrated circuit and the number of bonding zones, improve the reliability, and increase the operating space for component operations.

The foregoing summary is not intended to summarize each electric potential embodiment or every aspect of the present disclosure.

BRIEF DESCRIPTION OF THE DRAWINGS

The foregoing and other features and advantages of the disclosure will be apparent to those skilled in the art in view of the following detailed description, taken in conjunction with the accompanying drawings.

DETAILED DESCRIPTION

Figure 1:
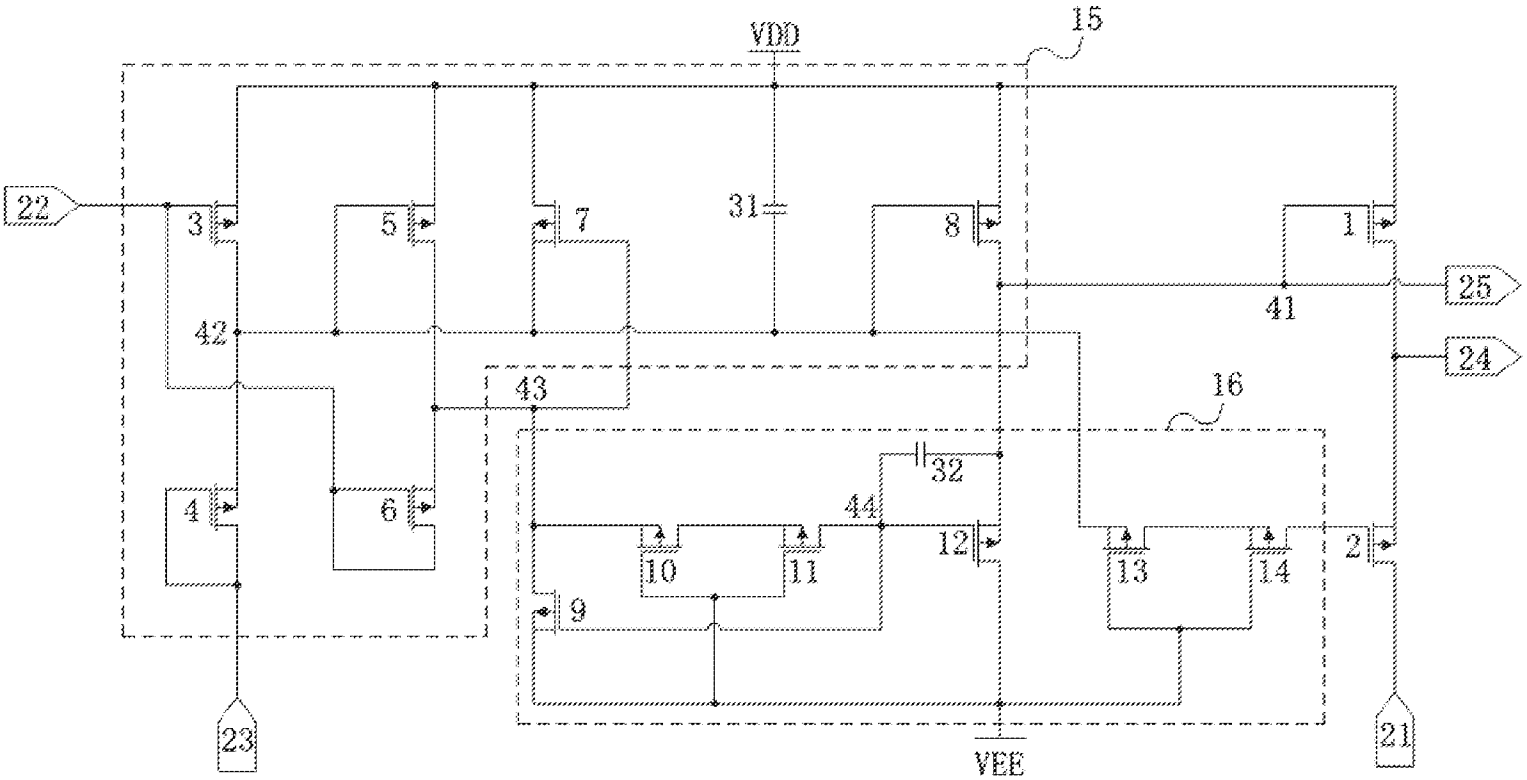
FIG. 1 illustrates circuit diagrams of each driver stage in the display driver according to an embodiment of the disclosure.

Exemplary embodiments of the disclosure will now be described more fully with reference to the accompanying drawings, in which exemplary embodiments are shown. Exemplary embodiments of the disclosure may, however, be embodied in many different forms and should not be construed as being limited to the embodiments set forth herein; rather, these embodiments are provided so that this disclosure will be thorough and complete, and will fully convey the concept of exemplary embodiments to those skilled in the art. In the drawings, the thicknesses of layers and regions are exaggerated for clarity. Like reference numerals in the drawings denote like elements, and thus their description will be omitted.

The described features, structures, or/and characteristics of the disclosure may be combined in any suitable manner in one or more embodiments. In the following description, numerous specific details are disclosed to provide a thorough understanding of embodiments of the disclosure. One skilled in the relevant art will recognize, however, that the disclosure may be practiced without one or more of the specific details, or with other components, and so forth. In other instances, well-known structures, or operations are not shown or described in detail to avoid obscuring aspects of the disclosure.

Figure 2:
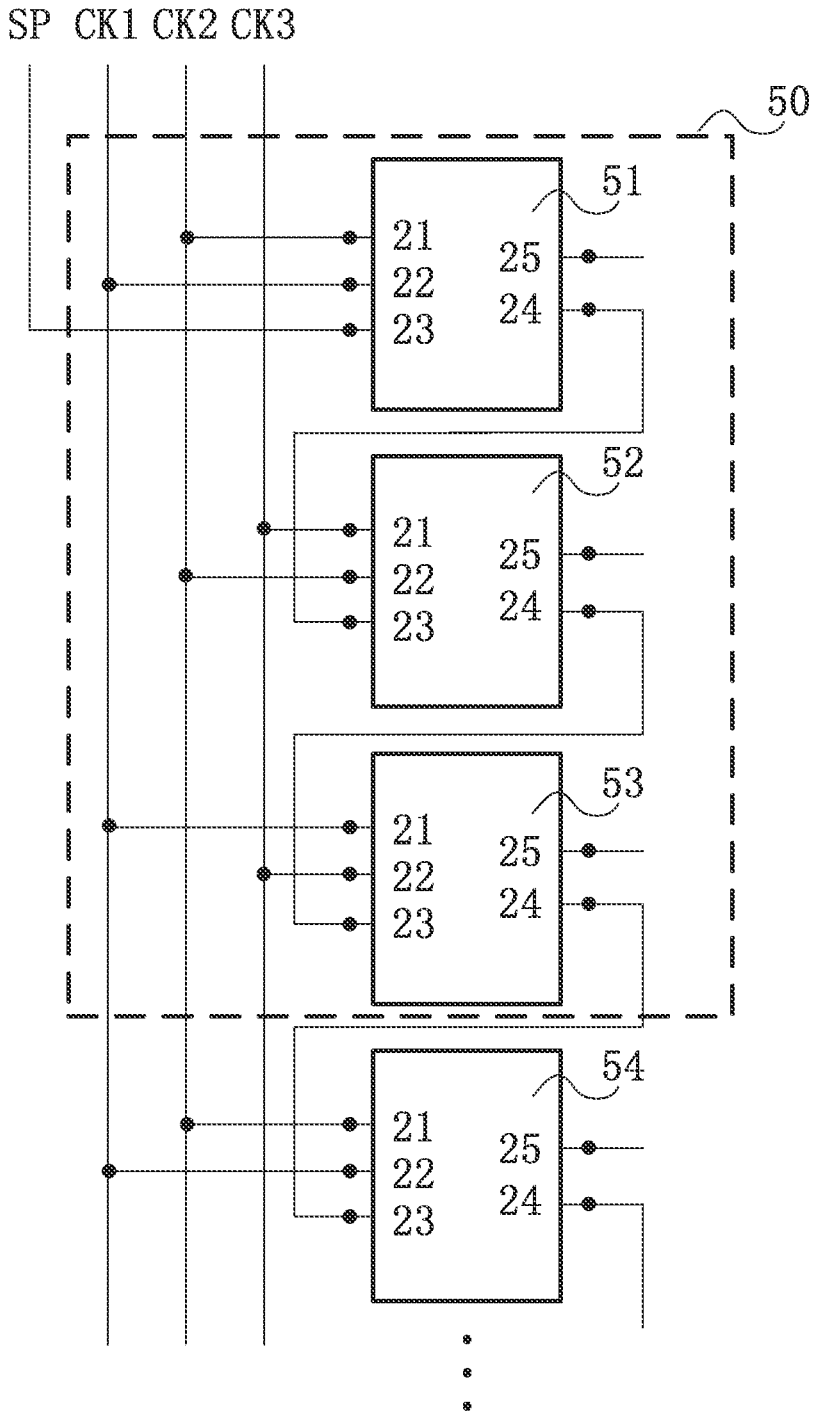
FIG. 2 illustrates a schematic diagram of the display driver according to an embodiment of the disclosure.

The display driver of the disclosure includes a plurality of driver stages. FIG. 1 illustrates a circuit diagram of the driver stage in the display driver according to an embodiment of the disclosure. As shown in FIG. 2, the display driver of the disclosure includes driver stages 51-54. Each driver stage includes a first transistor 1, a second transistor 2, a first controller 15 and a second controller 16 as shown in FIG. 1.

The source node of the first transistor 1 is electrically coupled to a first power supply VDD, the gate node thereof is electrically coupled to a first node 41, the drain node thereof is electrically coupled to a first output end 24, and the first transistor is configured to turn on or off according to a voltage applied to the first node 41. When the first transistor 1 turns on, the first power supply VDD (e.g. high level voltage) is provided to the first output end 24. As the first output end 24 is electrically coupled to a third input end 23 of the next driver stage, the high level voltage provided to the third input end 23 of the next driver stage may be taken as a multiplex signal.

The source node of the second transistor 2 is electrically coupled to the first output end 24, the gate node thereof is electrically coupled to the second controller 16, the drain node thereof is electrically coupled to a first input end 21, and the second transistor 2 is configured to turn on or off according to a voltage applied to the gate node of the second transistor 2. The first output end 24 of each driver stage is electrically coupled to the third input end 23 of the next driver stage. Therefore, when the second transistor 2 turns on, a signal of the first input end 21 is provided to the first output end 24. As the first output end 24 is electrically coupled to a third input end 23 of the next driver stage, the signal provided to the third input end 23 of the next driver stage may be taken as a multiplex signal.

The first controller 15 is electrically coupled to a second input end 22 and the third input end 23 and provides sampled signals to the first node and a second output end 25 according to input signals from the second input end 22 and the third input end 23. The first controller 15 includes a third transistor 3, a fourth transistor 4, a fifth transistor 5, a sixth transistor 6, a seventh transistor 7, an eighth transistor 8 and a first capacitor 31.

The source node of the third transistor 3 is electrically coupled to the first power supply VDD, the gate node thereof is electrically coupled to the second input end 22, and the drain node thereof is electrically coupled to a second node 42. The third transistor 3 turns on or off according to a signal from the second input end 22. When the third transistor 3 turns on, the first power supply VDD is electrically coupled to the second node 42.

The source node of the fourth transistor 4 is electrically coupled to the second node 42, the gate node thereof is electrically coupled to the third input end 23, and the drain node thereof is electrically coupled to the third input end 23.

The source node of the fifth transistor 5 is electrically coupled to the first power supply VDD, the gate node thereof is electrically coupled to the second node 42, and the drain node thereof is electrically coupled to a third node 43.

The source node of the sixth transistor 6 is electrically coupled to the third node 43, the gate node thereof is electrically coupled to the second input end 22, and the drain node thereof is electrically coupled to the second input end 22.

The source node of the seventh transistor 7 is electrically coupled to the second node 42, the gate node thereof is electrically coupled to the third node 43, and the drain node thereof is electrically coupled to the first power supply VDD.

The source node of the eighth transistor 8 is electrically coupled to the first power supply VDD, the gate node thereof is electrically coupled to the second node 42, and the drain node thereof is electrically coupled to the first node 41.

The first capacitor 31 is electrically coupled between the second node 42 and the first power supply VDD. The first capacitor 31 is used to hold the electrical potential of the second node 42 so as to avoid that the operation of the whole circuit is influenced by changes of the electrical potential of the second node 42 due to the leak current.

The first input end 21 is configured to receive a first clock signal, and the second input end 22 is configured to receive a second clock signal. The first clock signal and the second clock signal do not overlap with each other. The third input end 23 of the first driver stage is configured to receive a single pulse signal.

The second controller 16 is electrically coupled to the first controller 15, a second power supply VEE (e.g. low level voltage), which outputs a lower level voltage than that of the first power supply VDD, and the second transistor 2. The second controller 16 controls the gate node voltage of the second transistor 2. The second controller 16 includes a ninth transistor 9, a tenth transistor 10, an eleventh transistor 11, a twelfth transistor 12, a thirteenth transistor 13, a fourteenth transistor 14 and a second capacitor 32.

The source node of the ninth transistor 9 is electrically coupled to the second power supply VEE, the gate node thereof is electrically coupled to a fourth node 44, and the drain node thereof is electrically coupled to the third node 43.

The source node of the tenth transistor 10 is electrically coupled to the third node 43, and the gate node thereof is electrically coupled to the second power supply VEE.

The source node of the eleventh transistor 11 is electrically coupled to the drain node of the tenth transistor 10, the gate node thereof is electrically coupled to the second power supply VEE, and the drain node thereof is electrically coupled to the fourth node 44.

The source node of the twelfth transistor 12 is electrically coupled to the first node 41, the gate node thereof is electrically coupled to the fourth node 44, and the drain node thereof is electrically coupled to the second power supply VEE.

The source node of the thirteenth transistor 13 is electrically coupled to the second node 42, and the gate node thereof is electrically coupled to the second power supply VEE.

The source node of the fourteenth transistor 14 is electrically coupled to the drain node of the thirteenth transistor 13, the gate node thereof is electrically coupled to the second power supply VEE, and the drain node thereof is electrically coupled to the gate node of the second transistor 2.

The second capacitor 32 is electrically coupled between the first node 41 and the fourth node 44. The second capacitor 32 is used to couple the voltage of the fourth node 44 to a voltage lower than that of the second power supply VEE, so that the twelfth transistor 12 turns on thoroughly and outputs the electrical potential of VEE to the second output 25.

The display driver of the disclosure feeds back a sampled signal from a first output end to the third input end of the next drive circuit, so that it can use three signals to achieve the same effect as conventional solution.

FIG. 2 illustrates a schematic diagram of the display driver according to an embodiment of the disclosure. As shown in FIG. 2, the driver has a single pulse signal line SP and three clock signal lines CK1, CK2 and CK3. The three clock signal lines CK1, CK2 and CK3 transmit a first clock signal, a second clock signal and a third clock signal respectively.

A drive circuit group 50 has three drive circuit stages, e.g., a first driver stage 51, a second driver stage 52 and a third driver stage 53.

In this embodiment, the first input end 21 of the first driver stage 51 is electrically coupled to the second clock signal line CK2 and receives the second clock signal. The second input end 22 is electrically coupled to the first clock signal line CK1 and receives the first clock signal. The third input end 23 is electrically coupled to the single pulse signal line SP. The first output end 24 is couple to the third input end 23 of the second driver stage 52. The second output end 25 outputs a signal to the display region as a light emitting control signal.

The first input end 21 of the second driver stage 52 is electrically coupled to the third clock signal line CK3, and receives the third clock signal. The second input end 22 is electrically coupled to the second clock signal line CK2, and receives the second clock signal. The third input end 23 is electrically coupled to the first output end 24 of the first driver stage 51. The output end 24 of the second driver stage 52 is electrically coupled to the third input end 23 of the third driver stage 53. The second output end 25 outputs a signal to a display region as a light emitting control signal.

The first input end 21 of the third driver stage 53 is electrically coupled to the first clock signal line CK1, and receives the first clock signal. The second input end 22 is electrically coupled to the third clock signal line CK3, and receives the third clock signal. The third input end 23 is electrically coupled to the first output end 24 of the second driver stage 52. The second output end 25 outputs a signal to a display region as a light emitting control signal.

The first input end 21 of the fourth driver stage 54 is electrically coupled to the second clock signal line CK2, and receives the second clock signal. The second input end 22 is electrically coupled to the first clock signal line CK1, and receives the first clock signal. The third input end 23 is electrically coupled to the first output end 24 of the third driver stage 53. The first output end 24 is electrically coupled to the third input end of the next driver stage (not shown in the figure). The second output end 25 outputs a signal to a display region as a light emitting control signal.

The connection manner between the clock signal lines and the first input 21 and the second input end 22 in the fourth driver stage 54 is same as that in the first driver stage 51.

Thus it can be seen that the first input end 21 and the second input end 22 in the 3n-th (n is a natural number) driver stages respectively receive the same clock signal. The first input end 21 and the second input end 22 in the (3n+1)-th (n is a natural number) driver stages respectively receive the same clock signal. And the first input end 21 and the second input end 22 in the (3n+2)-th (n is a natural number) driver stages respectively receive the same clock signal.

Alternative connection manners between the clock signal lines and the first input end 21 and the second input end 22 for driver stages in a drive circuit group 50 are also possible. The disclosure is not limited to the shown example.

Circuit diagrams for each driver stage of the drive circuit group 50 can refer to FIG. 1 and the corresponding description, which are omitted herewith for clarity.

Figure 3:
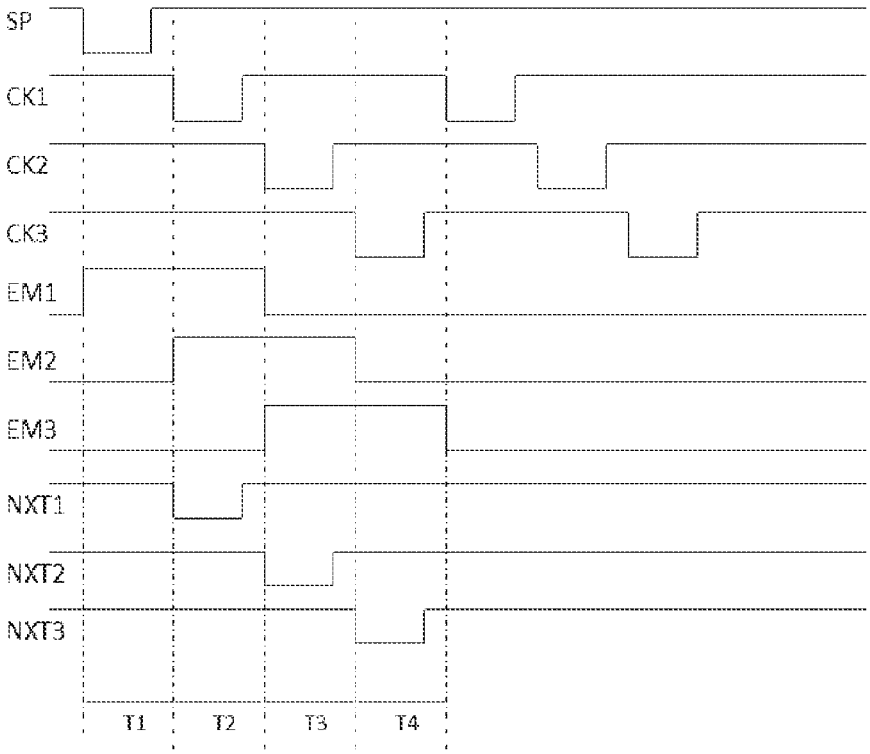
FIG. 3 illustrates a timing diagram of the display driver in use according to an embodiment of the disclosure.

FIG. 3 illustrates a timing diagram of the display driver in use according to an embodiment of the disclosure. SP is the signal on a single pulse signal line. CK1, CK2 and CK3 are the clock signals on three clock signal lines, respectively. EM1, EM2 and EM3 are the output signal from the second output ends 25 of three successive driver stages, respectively. NXT1, NXT2 and NXT 3 are the output signals from the first output ends 24 of three successive driver stages, respectively. As shown in FIG. 3, the display driver of the disclosure feeds back a sampled signal from the first output end to the third input end of the next drive circuit, so that it is possible to use three signals to achieve the same effect as the conventional solution.

This disclosure can be widely applied. The display device of the disclosure can be any one selected from a group consisting of an OLED display, a LCD, a FED or a plasma display panel.

Therefore, the display driver and the display device having the same according to the disclosure replace four clock signals with three signals, so that it can achieve same functions by using less control signals, which can save the area of circuit and reduce the area of integrated circuit and the number of bonding zones. Accordingly, the reliability is improved.

Exemplary embodiments have been specifically shown and described as above. It will be appreciated by those skilled in the art that the disclosure is not limited the disclosed embodiments; rather, all suitable modifications and equivalent which come within the spirit and scope of the appended claims are intended to fall within the scope of the disclosure.

What is claimed is:

1. A display driver, comprising a plurality of driver stages, each of which comprising a first input end, a second input end, a third input end, a first output end, a second output end, a first transistor, a second transistor, a first controller and a second controller, wherein a source node of the first transistor is electrically coupled to a first power supply, a gate node of the first transistor is electrically coupled to a first node, and a drain node of the first transistor is electrically coupled to the first output end;

a source node of the second transistor is electrically coupled to the first output end and a gate node of the second transistor is electrically coupled to the second controller, and a drain node of the second transistor is electrically coupled to a first input end;

the first controller is electrically coupled to the second input end and the third input end to provide sampled signals to the first node and the second output end;

the second controller is electrically coupled to the first controller and a second power supply, and the first output end of each driver stage is electrically coupled to the third input end of the next driver stage.

2. The display driver of claim 1, wherein the first input end is configured to receive a first clock signal, the second input end is configured to receive a second clock signal, and the first clock signal and the second clock signal do not overlap each other.

3. The display driver of claim 1, wherein the third input end of a first driver stage is configured to receive a single pulse signal.

4. The display driver of claim 1, wherein the first controller comprises:

a third transistor, having a source node electrically coupled to the first power supply, a gate node electrically coupled to the second input end and a drain node electrically coupled to a second node;

a fourth transistor, having a source node electrically coupled to the second node, a gate node electrically coupled to the third input end and a drain node electrically coupled to the third input end;

a fifth transistor, having a source node electrically coupled to the first power supply, a gate node electrically coupled to the second node and a drain node electrically coupled to a third node;

a sixth transistor, having a source node electrically coupled to the third node, a gate node electrically coupled to the second input end and a drain node electrically coupled to the second input end;

a seventh transistor, having a source node electrically coupled to the second node, a gate node electrically coupled to the third node and a drain node electrically coupled to the first power supply;

an eighth transistor, having a source node electrically coupled to the first power supply, a gate node electrically coupled to the second node and a drain node electrically coupled to the first node; and a first capacitor electrically coupled between the second node and the first power supply.

5. The display driver of claim 1, wherein the second controller comprises:

a ninth transistor, having a source node electrically coupled to the second power supply, a gate node electrically coupled to a fourth node and a drain node electrically coupled to the third node;

a tenth transistor, having a source node electrically coupled to the third node, a gate node electrically coupled to second power supply and a drain node;

an eleventh transistor, having a source node electrically coupled to the drain node of the tenth transistor, a gate node electrically coupled to the second power supply and a drain node electrically coupled to the fourth node;

a twelfth transistor, having a source node electrically coupled to the first node, a gate node electrically coupled to the fourth node and a drain node electrically coupled to the second power supply;

a thirteenth transistor, having a source node electrically coupled to the second node, a gate node electrically coupled to the second power supply and a drain node;

a fourteenth transistor, having a source node electrically coupled to the drain node of the thirteenth transistor, a gate node electrically coupled to the second power supply and a drain node electrically coupled to the gate node of the second transistor; and a second capacitor electrically coupled between the first node and the fourth node.

6. The display driver of claim 1, wherein an output voltage of the second power supply is lower than that of the first power supply.

7. A display device, comprising a plurality of driver stages, a single pulse signal line and three clock signal lines, each of the plurality of driver stages comprising a first transistor, a second transistor, a first controller and a second controller, wherein:

a source node of the first transistor is electrically coupled to a first power supply, a gate node of the first transistor is electrically coupled to a first node, and its drain node electrically coupled to a first output end;

a source node of the second transistor is electrically coupled to the first output end and a gate node of the second transistor is electrically coupled to a second controller and a drain node of the second transistor is electrically coupled to a first input end;

the first controller is electrically coupled to a second input end and a third input end to provide sampled signals to the first node and a second output end;

the second controller is electrically coupled to the first controller and a second power supply;

the first output end of each driver stage is electrically coupled to the third input end of the next driver stage;

the second output end of each driver stage output a light emitting control signal for the display device;

the third input end of a first driver stage is electrically coupled to the single pulse signal line; and three successive driver stages are configured as a drive circuit group, in which the first input end and the second input end of each driver stage are respectively electrically coupled to two clock signal lines of the three ones.

8. The display device of claim 7, wherein the three driver stages receive different clock signals from one another.

9. The display device of claim 7, wherein three clock signals respectively on the three clock signal lines do not overlap with one another.

10. The display device of claim 7, wherein the first controller comprises:

a third transistor, having a source node electrically coupled to the first power supply, a gate node electrically coupled to the second input end and a drain node electrically coupled to a second node;

a fourth transistor, having a source node electrically coupled to the second node, a gate node electrically coupled to the third input end and a drain node electrically coupled to the third input end;

a fifth transistor, having a source node electrically coupled to the first power supply, a gate node electrically coupled to the second node and a drain node electrically coupled to a third node;

a sixth transistor, having a source node electrically coupled to the third node, a gate node electrically coupled to the second input end and a drain node electrically coupled to the second input end;

a seventh transistor, having a source node electrically coupled to the second node, a gate node electrically coupled to the third node and a drain node electrically coupled to the first power supply;

an eighth transistor, having a source node electrically coupled to the first power supply, a gate node electrically coupled to the second node and a drain node electrically coupled to the first node; and a first capacitor electrically coupled between the second node and the first power supply.

11. The display device of claim 7, wherein the second controller comprises:

a ninth transistor, having a source node electrically coupled to the second power supply, a gate node electrically coupled to a fourth node and a drain node electrically coupled to the third node;

a tenth transistor, having a source node electrically coupled to the third node, a gate node electrically coupled to second power supply and a drain node;

an eleventh transistor, having a source node electrically coupled to the drain node of the tenth transistor, a gate node electrically coupled to the second power supply and a drain node electrically coupled to the fourth node;

a twelfth transistor, having a source node electrically coupled to the first node, a gate node electrically coupled to the fourth node and a drain node electrically coupled to the second power supply;

a thirteenth transistor, having a source node electrically coupled to the second node, a gate node electrically coupled to the second power supply and a drain node;

a fourteenth transistor, having a source node electrically coupled to the drain node of the thirteenth transistor, a gate node electrically coupled to the second power supply and a drain node electrically coupled to the gate node of the second transistor; and a second capacitor electrically coupled between the first node and the fourth node.

12. The display driver of claim 7, wherein an output voltage of the second power supply is lower than that of the first power supply.

13. The display device of claim 7, wherein the display device is one selected from a group consisting of an organic light-emitting display, a liquid crystal display, a field emission display and a plasma display panel.

* * * * *